US006899039B2

(12) United States Patent
Perazzo

(10) Patent No.: US 6,899,039 B2
(45) Date of Patent: May 31, 2005

(54) METHOD AND ASSOCIATED SYSTEM FOR MANUFACTURING REINFORCED PAPERBOARD PALLET RUNNERS

(76) Inventor: John R. Perazzo, 3805 Sherbrooke Dr., Cincinnati, OH (US) 45241

( * ) Notice: Subject to any disclaimer, the term of this patent is extended or adjusted under 35 U.S.C. 154(b) by 124 days.

(21) Appl. No.: 10/186,013

(22) Filed: Jun. 28, 2002

(65) Prior Publication Data

US 2002/0166481 A1 Nov. 14, 2002

Related U.S. Application Data

(63) Continuation-in-part of application No. 09/629,530, filed on Jul. 31, 2000, now Pat. No. 6,453,827, which is a continuation-in-part of application No. 09/182,263, filed on Oct. 29, 1998, now Pat. No. 6,095,061.

(51) Int. Cl.[7] ..... A65D 19/00
(52) U.S. Cl. ..... 108/51.3
(58) Field of Search ..... 108/563, 51.11, 108/56.1; 478/184; 493/462; 206/599, 600

(56) References Cited

U.S. PATENT DOCUMENTS

| | | | | |
|---|---|---|---|---|
| 1,754,784 | A | | 4/1930 | Borsodi |
| 2,503,240 | A | | 4/1950 | Cahners |
| 2,583,443 | A | | 1/1952 | Perry et al. |
| 2,904,297 | A | | 9/1959 | Hamilton |
| 2,958,494 | A | | 11/1960 | Lovegreen |
| 2,997,266 | A | * | 8/1961 | Munroe ..... 108/51.3 |
| 3,165,078 | A | | 1/1965 | White |
| 3,301,200 | A | | 1/1967 | Landsledel |
| 3,302,593 | A | | 2/1967 | Roberts |
| 3,477,395 | A | | 11/1969 | Brown et al. |
| 3,556,886 | A | | 1/1971 | Reusser |
| 3,709,161 | A | | 1/1973 | Kauffman |
| 3,911,182 | A | | 10/1975 | Lieberman |
| 3,911,834 | A | | 10/1975 | Quaintance |
| 3,942,654 | A | | 3/1976 | Warrick |
| 4,185,565 | A | | 1/1980 | Nymoen |
| 4,319,530 | A | | 3/1982 | Moog |
| 4,424,753 | A | | 1/1984 | Eatherton |
| 4,790,249 | A | | 12/1988 | Webb |
| 4,792,325 | A | | 12/1988 | Schmidtke |
| 4,863,024 | A | | 9/1989 | Booth |
| 4,955,940 | A | | 9/1990 | Welleman |
| 4,979,446 | A | | 12/1990 | Winebarger |
| 5,156,094 | A | | 10/1992 | Johansson et al. |
| 5,184,558 | A | | 2/1993 | Wozniacki |

(Continued)

FOREIGN PATENT DOCUMENTS

| | | | |
|---|---|---|---|
| FR | 2490167 | | 3/1982 |
| FR | 2713201 | | 12/1993 |
| JP | 6-171648 | * | 6/1994 |

OTHER PUBLICATIONS

PCT/US02/21104, *International Search Report*, Apr. 16, 2004.

*Primary Examiner*—Jose V. Chen
(74) *Attorney, Agent, or Firm*—Wood, Herron & Evans, LLP

(57) ABSTRACT

A pallet includes a number of runners which may be sandwiched between upper and lower face sheets of corrugated paperboard. Each runner is comprised of multiple layers of corrugated paperboard with the flutes of the corrugations oriented vertically to provide compression strength to the runners and the associated pallet. Each runner also may include at least one reinforcing insert most preferably of hardboard to provide beam strength to the runner and a band to avoid failure without a prior indication. Moreover, the system and method for manufacturing the runners with reinforcing inserts overcomes problems of delaminating and separation of the adhesively bonded layers of the runner.

26 Claims, 6 Drawing Sheets

U.S. PATENT DOCUMENTS 5,207,631 A 5/1993 Schmidtke et al.
5,218,913 A 6/1993 Winebarger et al.
5,222,444 A 6/1993 Youell, Jr. et al.
5,285,731 A 2/1994 McIntyre
5,337,679 A 8/1994 Moorman
5,357,875 A 10/1994 Winebarger et al.
5,366,790 A * 11/1994 Liebel ..... 428/184
5,411,786 A 5/1995 Kuo
5,413,662 A 5/1995 Skinner, III
5,425,314 A 6/1995 MacFarland
5,427,019 A 6/1995 Moorman
5,433,156 A 7/1995 Hutchison
5,461,988 A 10/1995 Cummings et al.
5,465,672 A 11/1995 Boyse et al.
RE35,131 E 12/1995 Youell, Jr. et al.
5,487,345 A 1/1996 Winebarger et al.
5,493,962 A 2/1996 McCarthy
5,495,810 A * 3/1996 Yoshii ..... 108/51.3
5,520,982 A 5/1996 Grigsby et al.
5,528,994 A 6/1996 Iseli
5,531,165 A 7/1996 Taravella et al.
5,531,166 A 7/1996 Woods et al.
5,537,936 A * 7/1996 Cordrey ..... 108/51.3
5,551,353 A 9/1996 Fiedler
5,568,774 A 10/1996 Hutchison
5,569,148 A * 10/1996 LaFreniere et al. ..... 493/462
5,584,951 A 12/1996 MacFarland
5,601,035 A * 2/1997 Herring et al. ..... 108/51.3
5,609,557 A 3/1997 Te
5,685,234 A 11/1997 Grigsby et al.
5,694,863 A 12/1997 Chen
5,996,509 A 12/1999 Lai
6,076,475 A 6/2000 Kuhn et al.
6,095,061 A * 8/2000 Perazzo ..... 108/51.3
6,135,030 A 10/2000 Besaw
6,155,181 A 12/2000 Chilcutt
6,453,827 B1 * 9/2002 Perazzo ..... 108/51.3

* cited by examiner

METHOD AND ASSOCIATED SYSTEM FOR MANUFACTURING REINFORCED PAPERBOARD PALLET RUNNERS

This is a continuation-in-part of U.S. patent application Ser. No. 09/629,530 filed Jul. 31, 2000 now U.S. Pat. No. 6,453,827 which in turn was a continuation-in-part of U.S. patent application Ser. No. 09/182,263 filed Oct. 29, 1998 and issued as U.S. Pat. No. 6,095,061 on Aug. 1, 2000. Each of these patents/applications are hereby incorporated by reference in its entirety.

BACKGROUND OF THE INVENTION

This invention relates to a method and associated system for manufacturing a runner for use alone or with a pallet in the storage and/or transport of goods and, more particularly, to such a system and method for manufacturing a recyclable and reinforced runner and pallet design.

For many years, various types of objects have been used to separate and support loads that are stored and transported generally in a stacked arrangement. The equipment that is primarily used for performing this stacking arrangement is a front end loader, lift truck or fork lift truck which raises the individual loads so that they can be stacked one on top of the other or on a rack. To separate the loads from each other, off the rack or off of the floor, a pallet, riser or runner is positioned beneath the load so as to allow space for the insertion of the forks of the lift truck or the like for moving and positioning the loads for storage or transportation. Generally, the load supporting pallets are mainly made from wood and consist of platforms having parallel runners longitudinally and/or transversely secured to the underside by nails, staples, strapping or other suitable fasteners.

While such wooden pallets in the past have been found to be satisfactory in many regards for their intended use in transporting and storage of materials and articles from one location to another, there are many disadvantages associated with wooden pallets. Increased environmental awareness has become a significant factor in the packaging, transportation and shipping industries. Wood is difficult to readily recycle and, hence, many wood packaging or pallet components are finally disposed of in land fills. However, available land fill sites are becoming full and, if available, require significant fees for dumping such materials.

For the international shipment of goods, wooden pallets present additional environmental problems because they tend to serve as hosts for germs and bugs. Wooden pallets are often quarantined or burned upon arrival in the destination country according to governmental regulations or general precautionary practices to avoid the spread of undesirable insects, bugs or germs.

To avoid some of the objections to the use of wood pallets, alternative pallet designs utilize materials such as corrugated paperboard, scrapped paperboard, plastics, aluminum and other materials. While solving certain problems associated with wood pallets, pallets and runners from non-wood materials often have significant deficiencies. While non-wood pallets may be light weight and inexpensive for some applications, their strength and rigidity under static and dynamic loading is insufficient to permit wide spread general use for all types of goods. Such non-wood pallets often have excessive deflection and lack beam strength which causes their sagging under loads thereby making the handling, stacking and racking of the pallets impractical and even dangerous. Many so called improved pallet designs do not offer the strength necessary to withstand buckling, crushing or compression when placed upon a rack under a load.

A solution to many of these problems is disclosed in applicant's own prior U.S. Pat. No. 6,095,061 which discloses a reinforced, rackable and recyclable pallet and runner. The pallet/runner design disclosed in the '061 patent is light weight and provides significant strength and increased load bearing capability and resistance to compression and crushing while still providing the significant advantages of being entirely processable in a paperboard recycling system or the like for convenient, economical and ecological disposal.

The '061 patent discloses a pallet which includes at least two spaced generally parallel runners and each of the runners is constructed of a number of layers of double wall or double face corrugated paperboard glued together in face-to-face orientation with the flutes of the corrugations being generally aligned in a generally vertical direction. Each of the runners also includes at least one generally vertically oriented reinforcing insert positioned between adjacent layers of the corrugated paperboard.

One method for manufacturing such a runner is to laminate layers of corrugated paperboard one on top of another in face-to-face relation with the reinforcing insert or inserts positioned therein. The various layers of paperboard and reinforcing insert may be adhered in a face-to-face relation by an adhesive commonly known in the industry to form the billet. Typically, the billet of sheets or layers of corrugated paperboard and reinforcing insert is then stacked with similar billets one on top of another, typically four to six high, and compressed in an effort to bond the various layers in the respective billets to one another. After compressing the multiple billets in a single batch process, the individual billets are then sawed or cut into the individual runners for ultimate use or incorporation into a pallet.

However, applicant discovered that during the production of the runners according the '061 pallet and the above described method, frequently the adjacent layers of paperboard separate one from another and/or from the reinforcing insert particularly at the lateral ends of the runners. Increased pressure on the multiple billets, increased adhesive volume and alternative adhesives did not significantly improve the situation or minimize the occurrence of runner separation. Therefore, a need exists for an improved method and associated system for manufacturing paperboard pallet runners that have at least one reinforcing insert that avoids the problem of delaminating or separation of the adjacent layers of glued materials.

SUMMARY OF THE INVENTION

The improved method and associated system for manufacturing a runner adapted to support a load during transit and storage by itself or in combination with a pallet overcomes the above-described disadvantages. Advantageously, the manufacturing method and system for a runner according to this invention economically, efficiently and reliably produces a runner having a number of layers of corrugated paperboard and a reinforcing insert therein, such as that shown in U.S. Pat. No. 6,095,061. Moreover, the improved manufacturing method and system produces a runner that does not delaminate or separate after the billet is constructed.

Specifically, a presently preferred method of manufacturing a runner according to this invention includes juxtaposing a number of layers of corrugated paperboard together in which each layer of paperboard has generally parallel flutes and a pair of spaced faces. Each of the adjacent layers of paperboard are aligned in face-to-face relation and an adhesive is applied between the confronting faces of the adjacent layers of paperboard. At least one layer of a reinforcing insert is interposed between a pair of adjacent layers of corrugated paperboard. Advantageously, the reinforcing insert is recyclable and is most preferably hardboard or particleboard. The reinforcing insert is similarly oriented with respect to the layers of paperboard and in face-to-face relation therewith. Adhesive is applied between the confronting faces of each layer of the reinforcing insert and the adjacent layers of paperboard to form a billet.

Pressure is then applied to the billet in a direction generally perpendicular to the faces of the layers of paperboard to thereby bond the adhesive to the respective faces and adhere the layers together. Advantageously, the present invention benefits from the discovery that the layers of paperboard commonly have a degree of inherent curvature or warp and are not strictly planar layers. While pressure was applied to a number of billets in a stacked relation previously, having the reinforcing insert in each of the billets inhibits or prevents the pressure applied at the top and bottom of the multiple billet stack from transmitting through the entire stack to achieve optimum face-to-face contact between the warped layers of paperboard and adjacent layers. The slightly warped configuration of the paperboard is inherent in the material. However, typically the reinforcing insert of hardboard, particleboard or the like is not warped. One of the many advantages that the reinforcing insert provides to the runner is significant strength and load bearing capability while resisting compression or crushing of the runner. While these characteristics of the reinforcing insert are beneficial to the ultimate utility of the resulting runner, these characteristics also minimize the effectiveness of the pressure applied to a stack of multiple billets during prior manufacturing practices. The pressure applied to the stack of billets was not transmitted through the various layers to overcome the warp of the corrugated paperboard layers because of the reinforcing inserts. Therefore, proper face-to-face contact between various adjacent layers of the paperboard and reinforcing insert was not obtained in prior manufacturing operations. As such, the adhesive between such layers of paperboard and adjacent layers of paperboard or reinforcing insert did not effectively bond the layers together which ultimately resulted in delamination or separation of the runner at those locations.

However, with the present invention, pressure is applied to only a single billet or a limited number of assembled layers to thereby achieve increased face-to-face contact and adhesive bonding between the adjacent layers. Applying pressure to only one billet or a limited number of layers allows the assembly process to effectively achieve adequate face-to-face contact to allow adequate bonding of the adhesive. The reinforcing insert does not detrimentally minimize the ability of the pressure applying process to overcome the slight warp in the paperboard layers. Therefore, the warp in the paperboard layers is effectively overcome by the pressure and adequate face-to-face contact is achieved to avoid delamination and separation of the resulting runner. Ultimately, the bonded billet of paperboard and reinforcing insert layers is cut or sawed in a direction generally perpendicular to the layers to separate individual runners from the billet for use directly on the load or as part of a pallet during the storage and shipping and goods.

The associated system for manufacturing a runner according to a presently preferred embodiment of this invention includes a pair of gluing stations for applying adhesive to at least one face of selected layers of paperboard and reinforcing insert. One of the gluing stations is utilized for applying adhesive to the paperboard and the other gluing station applies adhesive to the reinforcing insert layers. Downstream from the gluing stations is a set-up station is provided to arrange and juxtapose the various layers of paperboard and reinforcing insert in face-to-face relationship to form a billet.

The system includes at least one or a number of pressing stations down stream from the set-up station for applying pressure to each of the billets individually or to a limited number of layers. Once again, the pressure is applied in a direction generally perpendicular to the layers of paperboard over substantially the entire surface area of the billet. The individual pressing stations are adapted to apply pressure to individual billets at a time to thereby overcome at least some of the warp in the paperboard layers and achieve increased face-to-face contact and adhesive bonding between the adjacent layers. A cutting station which in one embodiment includes a number of parallel circular saw blades spaced one from another is located downstream from the pressing stations. The cutting station cuts the individual billets in a direction generally perpendicular to the layers of paperboard and reinforcing insert to separate the individual runners. The system also includes a mechanism for transferring the various layers of paperboard, reinforcing insert and billets to and between the respective stations in the form of roller conveyors, wheeled carts on rails or the like.

As a result of the improved manufacturing system and associated method for producing recyclable paperboard runners with reinforcing inserts according to this invention, delamination and separation of the resulting runners is avoided. As a result, the manufacturing operation is significantly more efficient, effective and reliable while minimizing ways to end defective runners as a result of the benefits of overcoming the slight warp inherent in the layers of corrugated paperboard to achieve appropriate face-to-face contact and adhesive bonding in the runner.

BRIEF DESCRIPTION OF THE DRAWINGS

The objectives and features of the invention will become more readily apparent from the following detailed description taken in conjunction with the accompanying drawings in which.

DETAILED DESCRIPTIONS OF THE INVENTION

Figure 1:
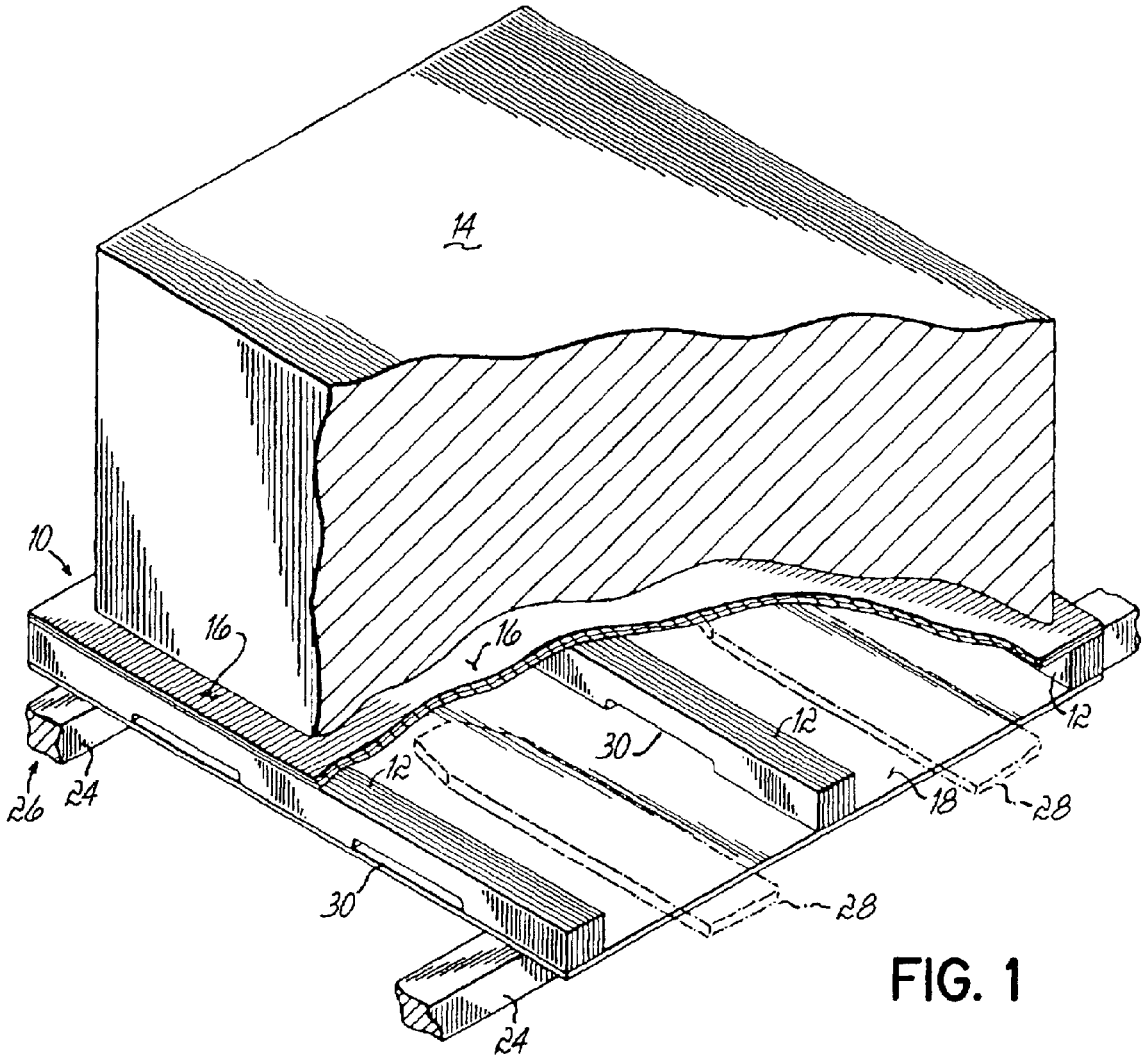
FIG. 1 is a perspective view of a presently preferred embodiment of a pallet having a number of spaced runners and supporting a load on a rack with a portion of the load and an upper deck sheet of the pallet being broken away to expose the runners of the pallet.

Referring to FIG. 1, a presently preferred embodiment of a pallet manufactured according to this invention is shown. The pallet 10 includes a plurality, three of which are shown in FIG. 1, of generally parallel runners 12. It will be readily understood that the pallet 10 supports a load 14 and may include two, four (FIG. 1A) or another number of runners 12 within the scope of this invention. The runners 12 are sandwiched between an upper deck sheet 16 adhered, preferably by adhesive or the like, to an upper surface of each of the runners 12 and a lower deck sheet 18, likewise adhered by adhesive or the like, to a lower surface of the runners 12. The lower deck 18 sheet contributes to the structural integrity of the pallet 10 when rolling down the rollers of a conveyor (not shown), without crushing or collapsing the pallet 10 under the load 14. The lower deck sheet 18 as such aids in the alignment of the runners 12 for proper vertical orientation while used on the conveyor. However, in certain applications, it would be understood that the lower deck sheet 18 and/or the upper deck sheet 16 may be eliminated. The pallet 10 supports the load 14 during transportation of the load 14 or storage thereof, for example, on the spaced beams 24 of a rack 26 such as that shown in FIG. 1. Typically, the beams 24 are spaced about 36 inches apart and in some applications are 42 inches apart and extend generally parallel to one another and perpendicular to the runners 12 in the pallet 10.

The runners 12 are spaced and generally parallel to one another so that tines 28 of a lift truck (not shown) or the like may be inserted between the runners 12 below the upper deck sheet 16 and above the lower deck sheet 18 for lifting, maneuvering and/or transporting the pallet 10 and load 14. Each of the runners 12 further includes a pair of spaced notches 30 which are generally aligned with the notches 30 in the other runners 12 of the pallet 10 and extend the width of the respective runner 12. The notches 30, according to one presently preferred form of the invention, are open to the bottom face of the runner 12 and provide for entry of the tines 28 of the lift truck into the runner 12 for lifting the pallet 10 and the load 14 for maneuvering and/or transporting the pallet 10 and load 14 combination. Alternatively, the runners 12 may include portals (not shown) formed as through holes generally perpendicular to the runner 12. As a result, the spaced runners 12 and notches 30 or portals thereof provide for four-way entry to the pallet 10 by the tines 28 of the lift truck or the like as is common in the popular Grocery Manufacturers Association (GMA) type pallets.

In a presently preferred form, each runner 12 is approximately 48 inches in length, 3.5 inches in width and 3.5 inches in height. Preferably, the upper and lower deck sheets 16, 18 (if provided) each measure approximately 40 inches by 48 inches and upstanding sidewalls of a tray configuration (not shown) of the upper deck sheet 16 are approximately 4 inches in height. The flutes of the upper and lower deck sheets 16, 18 are preferably oriented perpendicularly to the runners 12.

Figure 2:
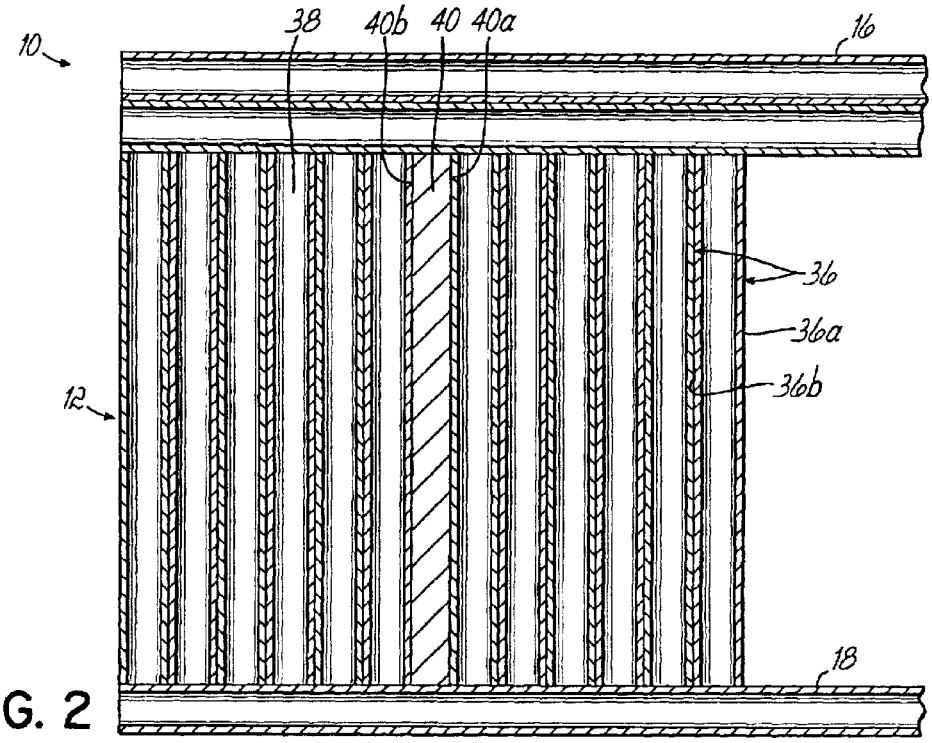
FIG. 2 is a cross-sectional enlarged view of a portion of a pallet including a runner according to one embodiment of this invention.
Figure 5:
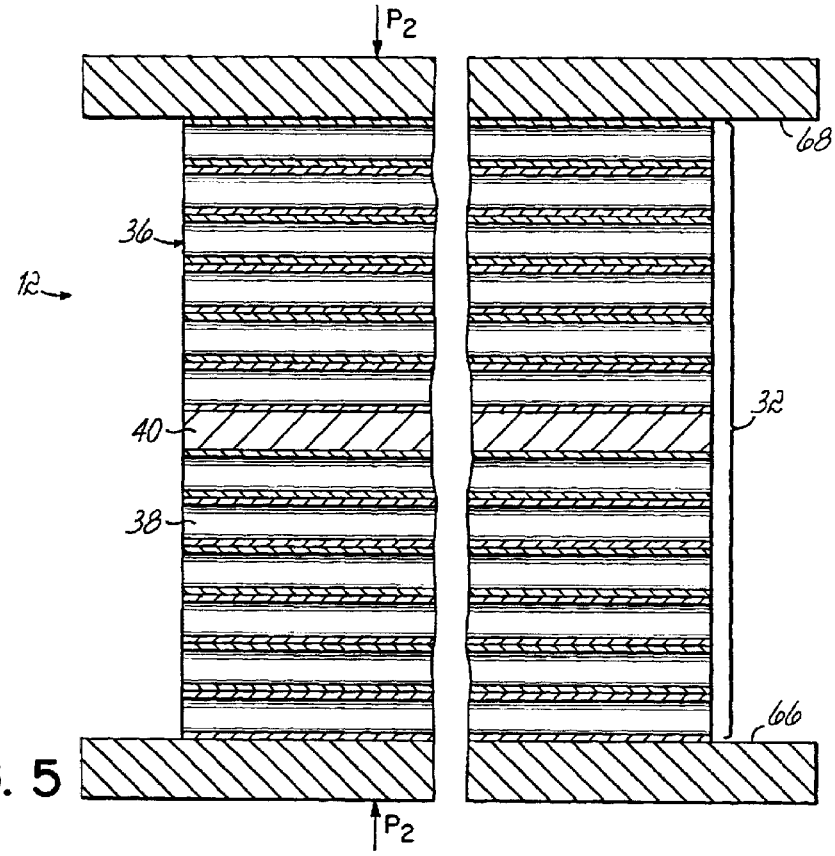
FIG. 5 is a side elevational view of a billet according to this invention under compression in which the inherent warp of the paperboard layers is overcome to thereby achieve face-to-face contact over substantially the entire surface of the layers.

Referring to FIG. 2, a cross-sectional view of one embodiment of the pallet 10 and one of the runners 12 thereof is shown. Specifically, the runner 12 is preferably constructed of a plurality of layers of paperboard 36, each of which are corrugated and built up and adhered in face to face relation by an adhesive such as polyvinyl alcohol (PVA) or another suitable adhesive commonly known in the industry. Each layer of corrugated paperboard 36 of the runner 12 of FIG. 2 preferably is 125# paperboard with type A or type C flutes 38, although any flute configuration or paperboard can be employed with this invention. The flutes 38 in the runners 12 extend generally vertically in single wall or double face corrugated paperboard 38. Preferably, the runner 12 of FIG. 2 includes four plies of double wall corrugated paperboard 36 on either side of a center reinforcing insert 40 which is most preferably a layer of one-quarter inch thick hardboard. Advantageously, the reinforcing insert 40 is sandwiched interiorly of the runner 12 and is oriented generally vertically or perpendicular to the deck sheets 16, 18 to provide beam strength to the runner 12. Additionally, locating the reinforcing insert 40 on the interior of the runner 12 allows the corrugated paperboard 36 layers to assist in maintaining the reinforcing insert 40 vertical when the pallet 10 or runner 12 is loaded. The corrugated paperboard 36 and vertically aligned flutes 38 advantageously provide compression strength to the runner 12 and associated pallet 10 as well as the alignment of the runner 12; however, the corrugated paperboard offers little or no beam strength which is provided by the reinforcing insert 40.

According to the embodiment shown in FIG. 2, the lower deck sheet 18 is single wall 200#B corrugated paperboard. The upper deck sheet 16 is preferably double wall corrugated paperboard with type A or C flutes. The flutes of the deck sheets 16, 18 are oriented generally perpendicular to the longitudinal axis of the runners 12. In certain applications, a layer of hardboard or similar material may be used in place of or in addition to the corrugated paperboard of the upper and/or lower deck sheets 16, 18.

The reinforcing insert 40 is most preferably hardboard and provides beam strength and resistance to compression for the runner 12, but offers little or no alignment stability. Preferably, the reinforcing insert 40 is recyclable, provides added strength and is a piece of chipboard, fiberboard, linerboard, Kraft or paperboard. More preferably, the reinforcing insert 40 is a piece of particleboard and, most preferably, a piece of hardboard which provides increased load bearing capability to the runner 12 and associated pallet 10, increased resistance to compression and is entirely recyclable. However, hardboard is too costly and heavy to be economically and practically used as the only component of the runner/pallet design; therefore, it is advantageously used in combination with paperboard in this invention.

An alternative embodiment (not shown) of the runner 12 includes two or more reinforcing inserts 40, most preferably of hardboard, positioned proximate the exterior faces of the runner 12 with two layers of corrugated paperboard 36 on the exterior most sides of the hardboard and six layers of corrugated paperboard interposed between the reinforcing inserts 40, 40.

The runner 12 according to this invention may be used in combination with other runners 12 and applied directly to the bottom of the load 14. An adhesive is deposited onto the upper surface of the runner 12 which is preferably non-drying, non-permanent so that the runner 12 may be selectively applied and removed from the lower surface of the load 14 as required. Preferably, the adhesive is deposited onto the open flutes 38 of the paperboard 36 and cool air is blown upwardly from the runner 12 through the flutes 38 to cool the adhesive. Preferably, such an adhesive is Instant- Loc No. 346650 which can be commercially obtained from National Starch and Chemical Company in Cincinnati, Ohio. Preferably, a release agent such as Michem Release Coat No. 40 commercially available from Michelman, Inc. in Cincinnati, Ohio may also be applied.

Figure 3:
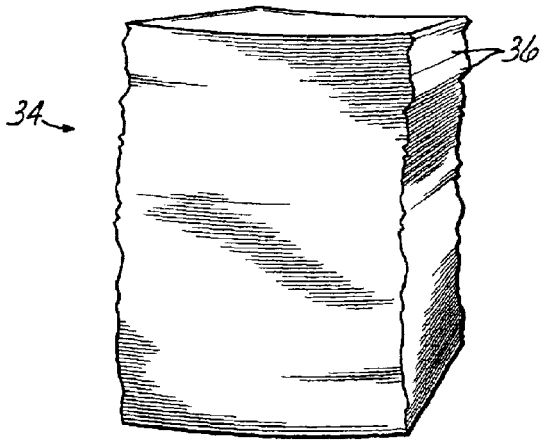
FIG. 3 is a perspective view of a stack of layers of corrugated paperboard showing inherent warp in the layers of paperboard.

Referring to FIG. 3, a stack 34 of corrugated paperboard 36 which may be utilized in the manufacture of the runner 12 according to this invention is shown. FIG. 3 demonstrates the fact that corrugated paperboard 36 of the type used in the runner 12 is not strictly planar but inherently includes a degree of curvature or slight warp across the surface area of the faces of the layers of paperboard. Preferably, during the manufacturing operations of the runner 12, the adjacent layers of paperboard 36 are similarly oriented so that the curvature or warp is oriented similarly with respect to the curvature or warp of the adjacent layers. Nevertheless, the adjacent layers of the corrugated paperboard 36 and reinforcing insert 40 in the runner 12 are not in face-to-face intimate contact.

Figure 8:
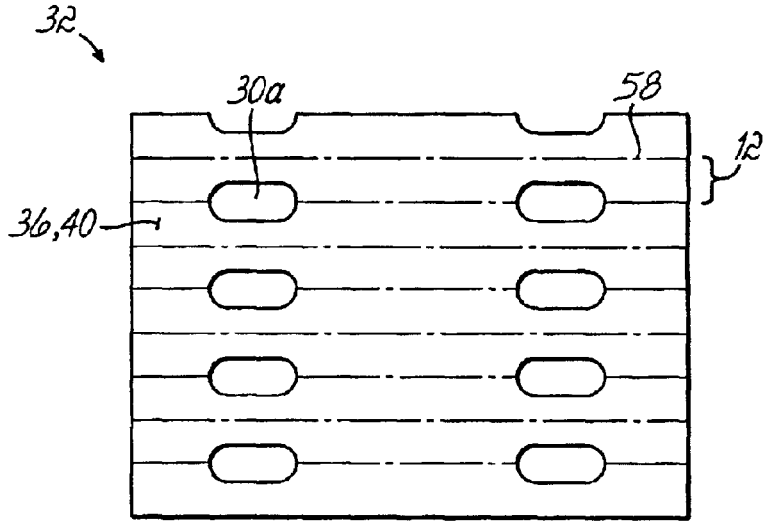
FIG. 8 is a top plan view of a billet used to manufacture runners according to one embodiment of this invention.

A top plan view of a top layer 36, 40 in a billet 32 is shown in FIG. 8. The layers 36, 40 may include appropriately positioned and configured ovals 30*a* as shown in FIG. 8. The layers 36, 40 of a billet 32 commonly are about 48 inches by 326 inches so that a number of runners 12 may be cut or separated from the assembled layers of paperboard and reinforcing insert. Cut lines 58 are shown in FIG. 8 to separate inward runners 12 from the billet 32.

Figure 6:
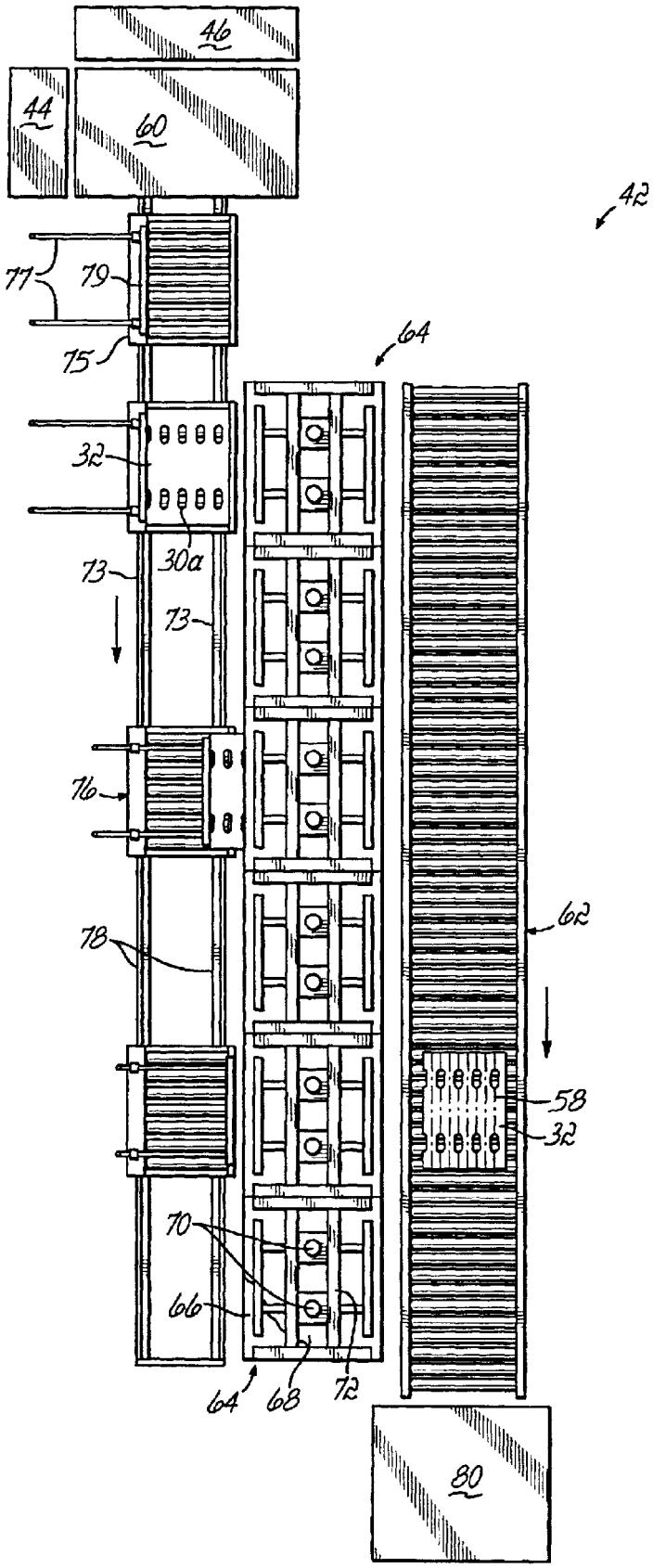
FIG. 6 is a top plan view of a system for manufacturing a runner according to one embodiment of this invention.

Referring to FIG. 6, one embodiment of a system 42 for manufacturing the runner 12 according to this invention is shown. The system 42 includes a pair of gluing stations 44, 46. One of the gluing stations 44 is particularly adapted for applying the adhesive to at least one and preferably both of the opposite faces 36*a*, 36*b* of each of a number of layers of corrugated paperboard 36. The other gluing station 46 is likewise adapted for applying adhesive to each of the opposite faces 40*a*, 40*b* of a layer of reinforcing insert 40. The gluing stations 44, 46 are schematically shown in cross section in FIG. 7 in which a pair of feed rollers 48, 48 are rotationally driven in counter rotation to one another to feed therebetween one of the layers 36 or 40 toward of counter-rotating adhesive application rollers. The outer periphery of each of the adhesive application rollers 50, 50 is ribbed and in contact with wetting roller 52, 52. Each wetting roller 50, 50 is likewise at least partially submerged in a reservoir 54 of adhesive so that upon rotation of the adhesive application roller 50, the wetting roller likewise rotates in contact with the outer periphery thereof. The adhesive is picked up from the reservoir 54 by the wetting roller and is likewise transferred to the outer ribbed surface of the adhesive application roller 50 for application to one of the faces 36*a*, 36*b*, 40*a*, or 40*b* of the layer of paperboard or reinforcing insert 36, 40. A pair of counter-rotating discharge rollers 56, 56 advance the layer 36 or 40 with adhesive thereon from the gluing station 44, 46. In one embodiment, the adhesive gluing stations 44, 46 are commercially available from Osama Technologies, Wood Working Machinery in San Gimignano, Italy.

As a result of this invention, the quantity of adhesive applied during the manufacture of the runners 12 is reduced to approximately two to three pounds per thousand square feet from approximately seven to eight pounds per thousand square feet in prior manufacturing operations. In addition to the reduction in the amount of adhesive utilized, the effectiveness of the adhesive is significantly increased because delamination and separation of the adjacent layers of paperboard is eliminated.

An additional feature of the gluing stations 44, 46 according to this invention alternatively includes foaming the adhesive prior to or in conjunction with application to the layers 36, 40 to further reduce adhesive consumption. Alternatively, the adhesive may be sprayed, drizzled or otherwise applied to the faces 36*a*, 36*b*, 40*a*, 40*b* of the layers 36, 40 within the scope of this invention.

Referring once again to the system of FIG. 6, in one embodiment the gluing stations 44, 46 are oriented approximately 90°from one another in conjunction with a set up station 60 at which the individual layers of paperboard 36 and reinforcing insert 40 are arranged into a billet of layers to be adhesively bonded together. The set up station 60 is located downstream from the gluing stations 44, 46 and upstream from a transfer mechanism 62 in the form of a conveyor having a plurality of rollers or carts 75 movable on rails 73 on which the billets 32 are transferred to be positioned adjacent one of a number of pressing stations 64 of the system 42. The individual billets 32 are transferred from each cart 75 by a pusher 79 movably mounted on a pair of bars 77, 77 on each cart 75.

To facilitate the efficient manufacture of a large quantity of runners 12, a number of pressing stations 64, six of which are shown adjacent the conveyor 62 in FIG. 6, are included in the system 42. However, it will be appreciated that any number of pressing stations 64 may be utilized within the scope of this invention. The billets 32 are transferred by the carts 75 along the rails 73, 73 to be adjacent one of the pressing stations 64 and are each then transferred by the pusher 79 to the respective pressing station 64 for processing. Each pressing station 64 may take one of a variety of forms for applying pressure to substantially the entire surface area of the upper and lower layers 36, 40 to achieve intimate face-to-face contact between the adjacent layers 36, 40 in the billet 32. Typically, the pressing station 64 may include a lower stationary platen 66 and an upper movable platen 68 for applying pressure to the billet 32 positioned therebetween. Movement of the upper platen 68 and the pressure P2 applied thereby to the billet 32 may be generated from one or more pneumatic cylinders 70 mounted on a frame 72 in the station 64.

In an alternative embodiment of this invention, the pressing stations 64 are arranged vertically one upon another and the billets 32 are delivered by lifts, conveyors or the like to the respective pressing stations 64. The vertical arrangement (not shown) of the pressing stations 64 is particularly advantageous for sites having limited floor space for the system 42.

Figure 4:
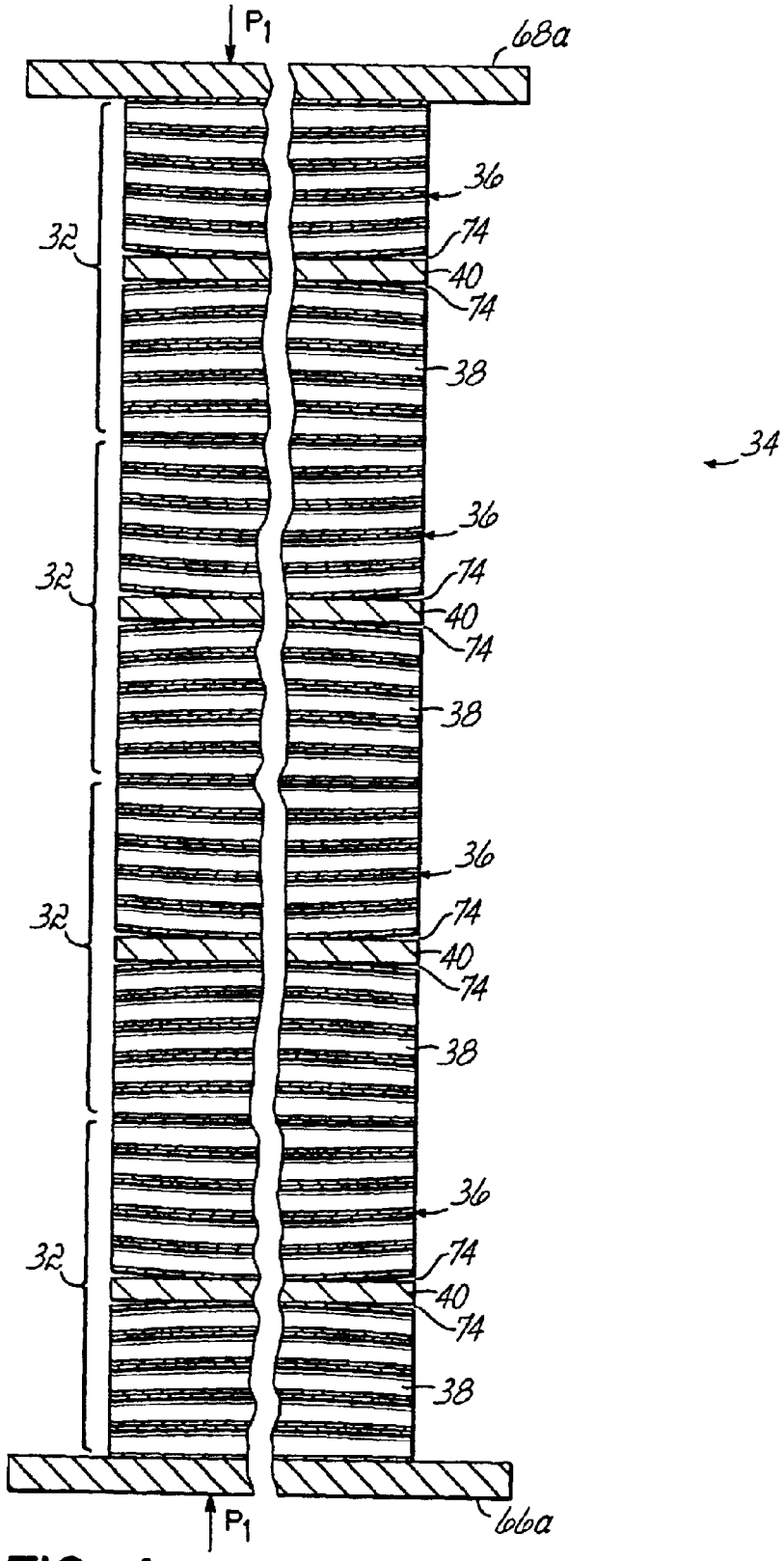
FIG. 4 PRIOR ART
FIG. 4 is a side elevational view of a stack of billets under pressure according to a prior art manufacturing operation in which selected layers of paperboard are not compressed into face to face contact with the adjacent layers.

In one embodiment, each pressing station 64 delivers $P_2$ of approximately 30 pounds per square foot of pressure to-the billet 32 to thereby overcome the warp or curvature in the layers of paperboard 36 and achieve appropriate face to face contact and bonding between the respective adjacent layers 36, 40. Previously, pressure $P_1$ in the amount of as much as 400 pounds per square foot of pressure was applied by platens 66*a*, 68*a* to the stack 34 of billets 32 as shown in FIG. 4 and the warp of the paperboard was not flattened out leaving gaps 74 preventing appropriate contact with the adjacent layers of paperboard and reinforcing insert 36, 40 for proper bonding. However, according to this invention, the pressing stations 64 and associated method apply pressure to a single billet 32, limited number of billets 32 or layers 36, 40 to appropriately achieve face-to-face contact while avoiding gaps 74 and overcoming the warp to thereby appropriately bond the layers 36, 40 together. Typically, each billet includes the layers of paperboard and reinforcing insert appropriate for a single runner.

Figure 7:
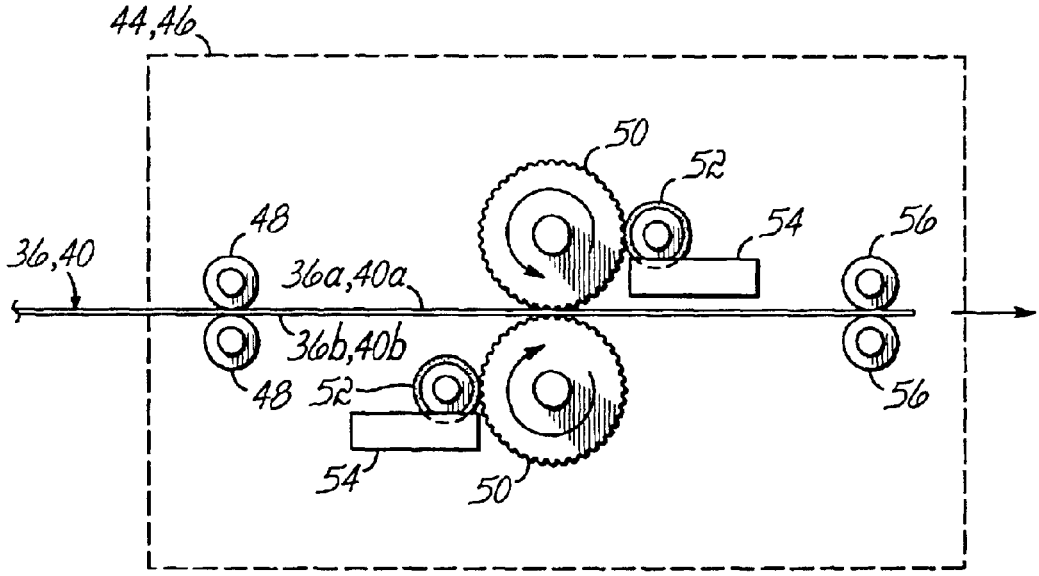
FIG. 7 is a side elevational schematic view of a gluing station of the system of FIG. 6.

After the pressure is applied to the billets in the individual pressing stations, typically for a duration of about 120 seconds, the individual billets 32 are then transferred to a roller conveyor 62 or an alternative transfer mechanism for transfer to and processing in a cutting station 80. The duration of the pressure on the billets 32 is highly dependent upon the type of adhesive used and should be adjusted appropriately as is know by those skilled in the art. The cutting station 80 includes a series of circular saw blades (not shown) spaced one from another, the spacing of which is determined by the height of the runner, typically 3.5 inches. At least one and preferably multiple runners 12 are severed by the cutting blades from the billet 32 along cut lines 58 as shown in FIG. 7. The cut lines 58 and oval cut-outs in the billet 32 are arranged for cutting the billet 32 to produce the notches 30 in the runner 12. According to the billet 32 shown in FIG. 6, nine runners 12 are to be cut from the billet 32, each with two notches 30 to provide the four-way entry into the runner 12 or resulting pallet 10. Alternatively, the ovals 30*a* may be appropriately positioned so that they do not intersect the cut lines 58 and portals in the runners 12 are generated according to an alternative embodiment of this invention.

Figure 9:
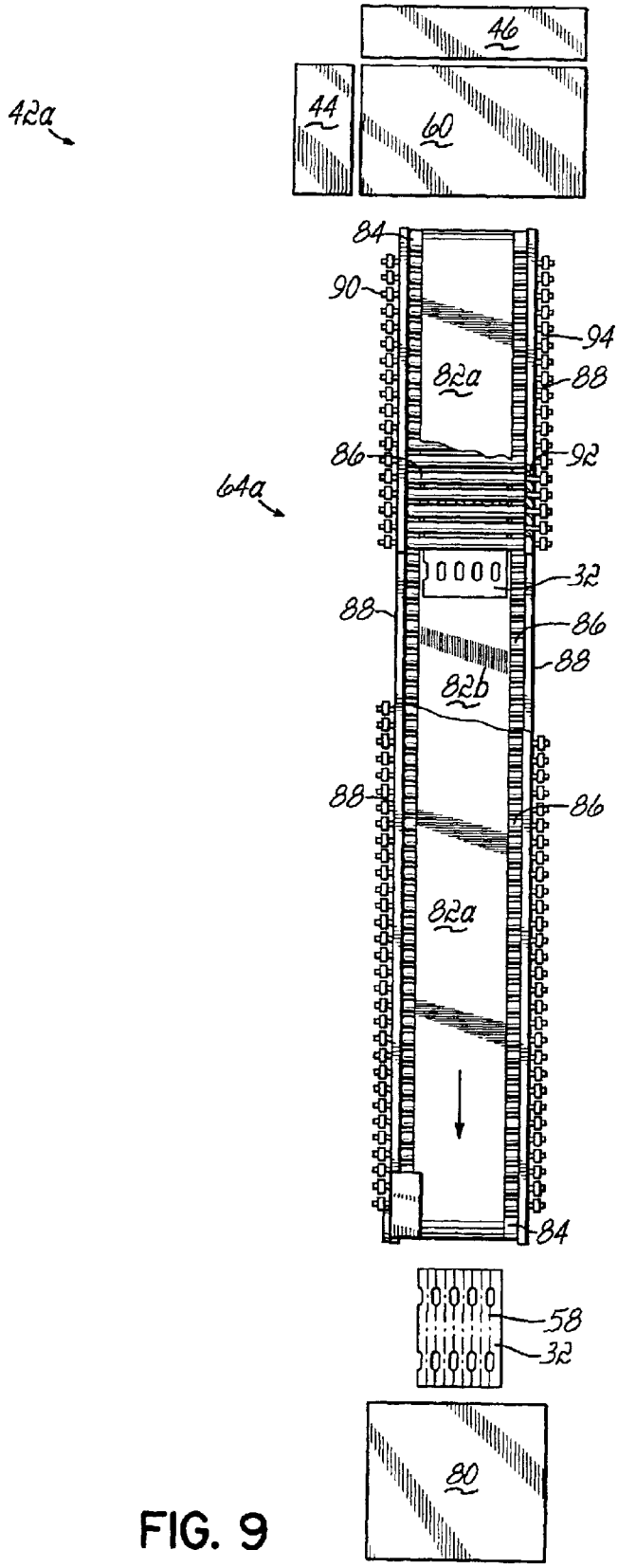
FIG. 9 is a top plan view of an alternative embodiment of a system for manufacturing the runner according to this invention.

Referring to FIG. 9, an alternative embodiment of a system 42*a* for manufacturing the runner 12 according to this invention is shown. Features of the system 42*a* of FIG. 9 that are common to the system 42 of FIG. 6 are identified by like reference numerals. The system 42*a* includes the pair of gluing stations 44, 46 arranged up stream from the set up station 60 at which the individual layers of paperboard 36 and reinforcing insert 40 are arranged into the billet 32 of layers to be adhesively bonded together.

Downstream from the set up station 60 of the system 42*a* is a pressing station 64*a* in the form of upper and lower belts 82*a* , 82*b* between which the individual billets 32 are serially food for pressing and processing. Each belt 82*a*, 82*b* is trained around a pair of end rollers 84 at least one of which is rotationally driven to pass the belt in an endless loop and advance the billets 32 through the pressing station 64*a* while being pressed. In one embodiment, each belt 82*a*, 82*b* is driven at a rate of about 25 feet/minute, is 60 inches wide and the associated end rollers 84 are spaced 20 feet apart. A number of intermediate rollers 86 are also provided in the pressing station 64*a* between each of the pair of end rollers 84. The rollers 84, 86 for each belt are mounted for rotation in a frame that includes a pair of side rails 88 at the opposite ends of the rollers 84, 86. The spacing of the side rails 88 of the upper belt 82*a* is fixed and preferably adjustable relative to the side rails 88 of the lower belt 82*b*. Preferably, each roller 86 for the upper belt 82*a* is mounted for rotation on a shaft 90 that extends through a slot 92 in each of the associated side rails 88.

The rollers 86 of the upper belt 82*a* are weighted to apply the requisite pressure to the billets 32 passing between the belts 82*a*, 82*b*. The spacing between the upper and lower belts 82*a*, 82*b* is determined by the thickness of the billets 32 being manufactured and rollers 86 of the upper belt 82*a* are movable vertically relative to the lower belt 82*b* on the shafts 90 in the slots 92 to accommodate variations in billet thickness and maintain pressure on the billet 32. Additionally, weights 94 can be added to the outboard portions of the roller shafts 90 of the upper belt 82*a* to increase the pressure being applied to the billets 32. Once the billets 32 pass through the pressing station 64*a* they are transferred to the cuffing station 80.

The system 42*a* and associated pressing station 64*a* affords the continuous production of billets 32 without operator involvement as an additional feature of the invention compared to the system 42 of FIG. 6. Additionally, the transfer of the billets from the set up station 60 and to the cutting station 80 is more easily and efficiently accomplished in the system 42*a* of FIG. 9.

Therefore, as a result of the system 42 or 42*a* and associated method for manufacturing reinforced paperboard pallet runners 12 of this invention, the reliability and effectiveness of the manufacturing operation is increased because runners 12 that separate or delaminate from one another are eliminated. Additionally, less force is required during the compression cycle of the manufacturing operation and consumption of adhesive is significantly reduced compared to prior manufacturing operations for runners of corrugated paperboard having warp along with a reinforcing insert.

From the above disclosure of the general principles of the present invention and the preceding detailed description of at least one preferred embodiment, those skilled in the art will readily comprehend the various modifications to which this invention is susceptible. Therefore, I desire to be limited only by the scope of the following claims and equivalents thereof.

I claim:

1. A method of manufacturing a runner adapted to support a load during transit and storage, the method comprising the steps of:

juxtaposing together a plurality of layers of paperboard each having a pair of spaced faces, wherein each of the adjacent layers of paperboard are in face to face relation;

applying an adhesive between confronting faces of adjacent layers of the paperboard;

adding at least one layer of a reinforcing insert each having a pair of spaced faces to the plurality of layers of paperboard, wherein each reinforcing insert layer is similarly oriented with respect to the plurality of layers of paperboard and in face to face relation to at least one of faces of one of the layers of paperboard;

applying the adhesive between confronting faces of each layer of the reinforcing insert and the adjacent layer of paperboard; and applying pressure to the layers of paperboard and reinforcing insert in a direction generally perpendicular to the faces of the layers of paperboard to thereby overcome at least some warp in the layers of paperboard and bond the adhesive to the respective faces and adhere the layers together.

2. A method of manufacturing a runner adapted to support a load during transit and storage, the method comprising the steps of:

juxtaposing together a plurality of layers of paperboard each having a pair of spaced faces, wherein each of the adjacent layers of paperboard are in face to face relation;

applying an adhesive between confronting faces of adjacent layers of the paperboard;

adding at least one layer of a reinforcing insert each having a pair of spaced faces to the plurality of layers of paperboard, wherein each reinforcing insert layer is similarly oriented with respect to the plurality of layers of paperboard and in face to face relation to at least one of faces of one of the layers of paperboard;

wherein the reinforcing insert layer is recyclable and selected from the group consisting of hardboard and particleboard;

applying the adhesive between confronting faces of each layer of the reinforcing insert and the adjacent layer of paperboard to form a billet; and applying pressure to the billet in a direction generally perpendicular to the faces of the layers of paperboard to thereby bond the adhesive to the respective faces and adhere the layers together.

3. A method of manufacturing a runner adapted to support a load during transit and storage, the method comprising the steps of:

juxtaposing together a plurality of layers of paperboard each having a pair of spaced faces, wherein each of the adjacent layers of paperboard are in face to face relation;

applying an adhesive between confronting faces of adjacent layers of the paperboard;

adding at least one layer of a reinforcing insert each having a pair of spaced faces to the plurality of layers of paperboard, wherein each reinforcing insert layer is similarly oriented with respect to the plurality of layers of paperboard and in face to face relation to at least one of faces of one of the layers of paperboard;

applying the adhesive between confronting faces of each layer of the reinforcing insert and the adjacent layer of paperboard to form a billet; and applying pressure to the billet in a direction generally perpendicular to the faces of the layers of paperboard to thereby bond the adhesive to the respective faces and adhere the layers together;

wherein the layers of paperboard have at least some warp and the pressure applying step is performed individually on each billet to thereby overcome at least some of the warp and achieve increased face to face contact and adhesive bonding between the adjacent layers of paperboard.

4. The method of claim 3 further comprising:

cutting the billet in a direction generally perpendicular to the faces into at least one individual runner.

5. The method of claim 4, wherein the cutting step further comprises:

cutting the billet along a plurality of generally parallel cut lines into a plurality of runners.

6. The method of claim 3 wherein the reinforcing insert layer is positioned interiorly of the billet between layers of the paperboard.

7. The method of claim 3 wherein the paperboard is corrugated paperboard including a plurality of generally parallel flutes, the method further comprising:

orienting the flutes of the layers of corrugated paperboard generally parallel to one another.

8. The method of claim 3 wherein a plurality of layers of reinforcing insert are added to the plurality of layers of paperboard and the plurality of layers of reinforcing insert are not adjacent to one another.

9. The method of claim 3 wherein the pressure is applied to substantially the entire surface area of the respective faces of outermost layers of the billet.

10. The method of claim 3 further comprising:

foaming the adhesive prior to the respective applying steps.

11. The method of claim 3 wherein the adhesive applying steps further comprise applying the adhesive to substantially the entire surface area of the respective faces of the layers.

12. The method of claim 3 wherein the adhesive applying steps further comprise applying the adhesive according to one of the following: spraying the adhesive, applying the adhesive with a roller, and applying the adhesive in a plurality of generally parallel streams of adhesive.

13. The method of claim 3 wherein the cutting further comprises sawing the billet.

14. The method of claim 3 wherein multiple billets are not juxtaposed together during the applying pressure step.

15. The method of claim 3 wherein the applying pressure step further comprises:

serially passing each of the billets between a pair of spaced and moving belts.

16. A method of manufacturing a runner adapted to support a load during transit and storage, the method comprising the steps of:

juxtaposing together a plurality of layers of corrugated paperboard each having a plurality of generally parallel flutes and a pair of spaced faces, wherein each of the adjacent layers of paperboard are in face to face relation;

applying an adhesive between confronting faces of adjacent layers of the paperboard;

adding at least one layer of a reinforcing insert each having a pair of spaced faces to the plurality of layers of paperboard;

wherein each reinforcing insert layer is recyclable and selected from the group consisting of hardboard and particleboard and is similarly oriented with respect to the plurality of layers of paperboard and in face to face relation to at least one of faces of one of the layers of paperboard;

applying the adhesive between confronting faces of each layer of the reinforcing insert and the adjacent layer of paperboard to form a billet;

applying pressure to the billet in a direction generally perpendicular to the faces of the layers of paperboard to thereby bond the adhesive to the respective faces and adhere the layers together;

wherein the layers of paperboard have at least some warp and the pressure applying step is performed individually on each billet to thereby achieve increased face to face contact and adhesive bonding between the adjacent layers of paperboard and reinforcing insert; and cutting the billet along a plurality of generally parallel cut lines into a plurality of runners.

17. The method of claim 16 wherein multiple billets are not juxtaposed together during the applying pressure step.

18. The method of claim 16 wherein the applying pressure step further comprises:

serially passing each of the billets between a pair of spaced and moving belts.

19. A runner adapted to support a load during transit and storage manufactured by the method comprising the steps of:

juxtaposing together a plurality of layers of corrugated paperboard each having a plurality of generally parallel flutes and a pair of spaced faces, wherein each of the adjacent layers of paperboard are in face to face relation;

applying an adhesive between confronting faces of adjacent layers of the paperboard;

adding at least one layer of a reinforcing insert each having a pair of spaced faces to the plurality of layers of paperboard;

wherein each reinforcing insert layer is recyclable and selected from the group consisting of hardboard and particleboard and is similarly oriented with respect to the plurality of layers of paperboard and in face to face relation to at least one of faces of one of the layers of paperboard;

applying the adhesive between confronting faces of each layer of the reinforcing insert and the adjacent layer of paperboard to form a billet;

applying pressure to the billet in a direction generally perpendicular to the faces of the layers of paperboard to thereby bond the adhesive to the respective faces and adhere the layers together;

wherein the layers of paperboard have at least some warp and the pressure applying step is performed on only a single billet at a time to thereby achieve increased face to face contact and adhesive bonding between the adjacent layers of paperboard and reinforcing insert; and cutting the billet along a plurality of generally parallel cut lines into a plurality of runners.

20. A system for manufacturing a runner adapted to support a load during transit and shipping, the system comprising:

a gluing station for applying adhesive to at least one face of selected layers of paperboard;

a set up station downstream from the gluing station for juxtaposing a plurality a plurality of layers of paperboard and at least one layer of a reinforcing insert in face to face relation; and a pressing station downstream from the set up station for applying pressure to the layers of paperboard and reinforcing insert in a direction generally perpendicular to the layers of paperboard to overcome at least some warp in the layers of paperboard and adhere the adjacent layers of paperboard and the layer of reinforcing insert to each other over substantially the entire surface area of the adjacent faces of the layers.

21. The system of claim 20 further comprising:

a cutting station downstream from the pressing station for cutting the layers generally perpendicular to the layers of paperboard and reinforcing insert into at least one runner.

22. A system for manufacturing a runner adapted to support a load during transit and shipping, the system comprising:

a gluing station for applying adhesive to at least one face of selected layers of paperboard;

a set up station downstream from the gluing station for juxtaposing a plurality a plurality of layers of paperboard and at least one layer of a reinforcing insert in face to face relation to form a billet; and a pressing station downstream from the set up station for applying pressure to the billet in a direction generally perpendicular to the layers of paperboard to adhere the adjacent layers of paperboard and the layer of reinforcing insert to each other over substantially the entire surface area of the adjacent faces of the layers;

wherein the system further comprises a plurality of the pressing stations wherein the layers of paperboard have at least some warp and each of the pressing stations is adapted to apply pressure to one billet at a time to thereby overcome at least some of the warp and achieve increased face to face contact and adhesive bonding between the adjacent layers of paperboard.

23. The system of claim 22 further comprising a plurality of the gluing stations one of which is adapted for applying adhesive to the layers of paperboard and another of which is adapted for applying adhesive to the layer of reinforcing insert.

24. The system of claim 22 further comprising:

a mechanism for transferring the layers of paperboard and reinforcing insert to and between the respective stations.

25. The system of claim 22 wherein the pressing station further comprises:

a pair of belts each trained around a plurality of rollers to pass in a loop, at least one of the belts being driven;

wherein the belts are spaced from one another and similarly oriented to accept the billets serially fed there between.

26. A system for manufacturing a runner adapted to support a load during transit and shipping, the system comprising:

a first and a second gluing station for applying adhesive to at least one face of selected layers of paperboard and reinforcing insert, the first gluing station being adapted for applying adhesive to the layers of paperboard and the second gluing station being adapted for applying adhesive to the reinforcing insert;

a set up station downstream from the gluing stations for juxtaposing a plurality a plurality of layers of paperboard and at least one layer of the reinforcing insert in face to face relation to form a billet; and a pressing station downstream from the set up station for applying pressure to the billet in a direction generally perpendicular to the layers of paperboard to adhere the adjacent layers of paperboard and the layer of reinforcing insert to each other over substantially the entire surface area of the adjacent faces of the layers;

wherein the layers of paperboard have at least some warp and the pressing station is adapted to apply pressure to individual billets to thereby overcome at least some of the warp and achieve increased face to face contact and adhesive bonding between the adjacent layers of paperboard;

wherein the pressing station further comprises a pair of belts each trained around a plurality of rollers to pass in a loop, at least one of the belts being driven;

wherein the belts are spaced from one another and similarly oriented to accept the billets serially fed there between; and a cutting station downstream from the pressing station for cutting the billet generally perpendicular to the layers of paperboard and reinforcing insert into at least one runner.

* * * * *